US007157689B1

(12) United States Patent
Schmidt

(10) Patent No.: US 7,157,689 B1
(45) Date of Patent: Jan. 2, 2007

(54) OPTICAL EDGE SENSING SYSTEM WITH SIGNAL AUTHENTICATION

(75) Inventor: Christoph Schmidt, Lawrenceville, NJ (US)

(73) Assignee: Fraba Inc., Princeton Junction, NJ (US)

( * ) Notice: Subject to any disclaimer, the term of this patent is extended or adjusted under 35 U.S.C. 154(b) by 260 days.

(21) Appl. No.: 10/976,108

(22) Filed: Oct. 28, 2004

Related U.S. Application Data

(60) Provisional application No. 60/515,003, filed on Oct. 28, 2003.

(51) Int. Cl.
*H01J 40/14* (2006.01)

(52) U.S. Cl. ..... 250/221; 250/227.14

(58) Field of Classification Search ..... 250/221, 250/227.14, 227.16, 222.1; 49/27, 26, 25
See application file for complete search history.

(56) References Cited

U.S. PATENT DOCUMENTS

| | | | | |
|---|---|---|---|---|
| 1,576,950 | A | | 3/1926 | Conklin |
| 1,634,665 | A | | 7/1927 | Hedley et al. |
| 2,135,131 | A | | 11/1938 | Bassett |
| 2,476,111 | A | | 7/1949 | Opalek |
| 3,168,165 | A | | 2/1965 | Bagnasco |
| 3,537,211 | A | | 11/1970 | Gulbert, Jr. |
| 4,301,621 | A | | 11/1981 | Houweling |
| 4,953,608 | A | | 9/1990 | Larsson |
| 4,984,658 | A | | 1/1991 | Peelle, Jr. et al. |
| 5,079,417 | A | * | 1/1992 | Strand ..... 250/221 |
| 5,233,185 | A | | 8/1993 | Whitaker |
| 5,426,293 | A | | 6/1995 | Miller et al. |
| 5,596,840 | A | | 1/1997 | Teich |
| 5,602,370 | A | | 2/1997 | Kau |
| 5,625,980 | A | | 5/1997 | Teich et al. |
| 5,728,984 | A | | 3/1998 | Miller |
| 5,743,320 | A | | 4/1998 | McKeon |
| 5,832,665 | A | | 11/1998 | Miller et al. |
| 5,929,406 | A | | 7/1999 | Thiel |
| 5,962,825 | A | | 10/1999 | Miller |
| 6,082,046 | A | | 7/2000 | Simmons |
| 6,176,039 | B1 | | 1/2001 | Craig |
| 6,683,296 | B1 | | 1/2004 | Miller et al. |

* cited by examiner

*Primary Examiner*—Que T. Le
(74) *Attorney, Agent, or Firm*—Mathews, Shepherd, McKay & Bruneau, P.A.

(57) ABSTRACT

An optical safety edge and control system functions correctly despite changes in ambient conditions and/or deformation of the sensor. The optical safety edge and control system automatically compensates for changes in ambient conditions and/or deformation, thus providing a simple easy to use edge sensor which reduces false responses and system failures.

20 Claims, 4 Drawing Sheets

OPTICAL EDGE SENSING SYSTEM WITH SIGNAL AUTHENTICATION

CROSS REFERENCES TO RELATED APPLICATIONS

This application claims the benefit under 35 U.S.C. 119(e) of U.S. Provisional Application Ser. No. 60/515,003, entitled Optical Edge Sensing With Signal Authentication, filed on Oct. 28, 2003.

FIELD OF THE INVENTION

This invention relates to edge sensors and more particularly to optical edge sensors.

BACKGROUND OF THE INVENTION

Safety is a major concern of users of automatic garage doors. Children and others have been injured by aggressive automatic garage doors. Since April 1982 Federal law has required that a closing garage door that is operated by an automatic opener must reverse off of a two-inch block. However, even with the safety improvements resulting from the April 1982 legislation, injuries continue to occur and safety is still an issue. Therefore, a new law as of Jan. 1, 1993 requires that a garage door opener must be equipped with a monitored non-contact safety reversing device or safety edge, which will automatically stop and reverse a closing garage door. The law also requires that, if these sensors become inoperative, the opener will not function.

One type of safety device is an electronic beam sensor which is installed at either side of the door opening which, when broken, will cause the door to stop and reverse itself. The photoelectric sensors are typically mounted about 5 to 6 inches off the floor on both sides of a garage door. These sensors operate with a garage door opener and send an invisible beam across the door opening. If that beam is broken while a motorized door is closing, the garage door opener will cause the door to reverse direction to the fully open position.

Another type of safety device is a pressure-sensitive electronic rubber strip, which attaches to the bottom of the door where it makes contact with the floor. When this sensor contacts an obstruction during the closing of the door, the opener will cause the door to reverse direction to the fully open position.

Just as with the beam sensor, when engaged, this safety edge will cause the door to stop and reverse itself avoiding injury or damage to property. However, the safety systems require periodic maintenance and adjustment. In particular, the pressure-sensitive system with age and use will develop false responses and failures.

Therefore there is a need to provide a simple easy to use edge sensor which reduces false responses and system failures.

SUMMARY OF THE INVENTION

The present invention is an optical safety edge and control system with automatic compensation for changes in ambient conditions and/or deformation.

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

Figure 1:
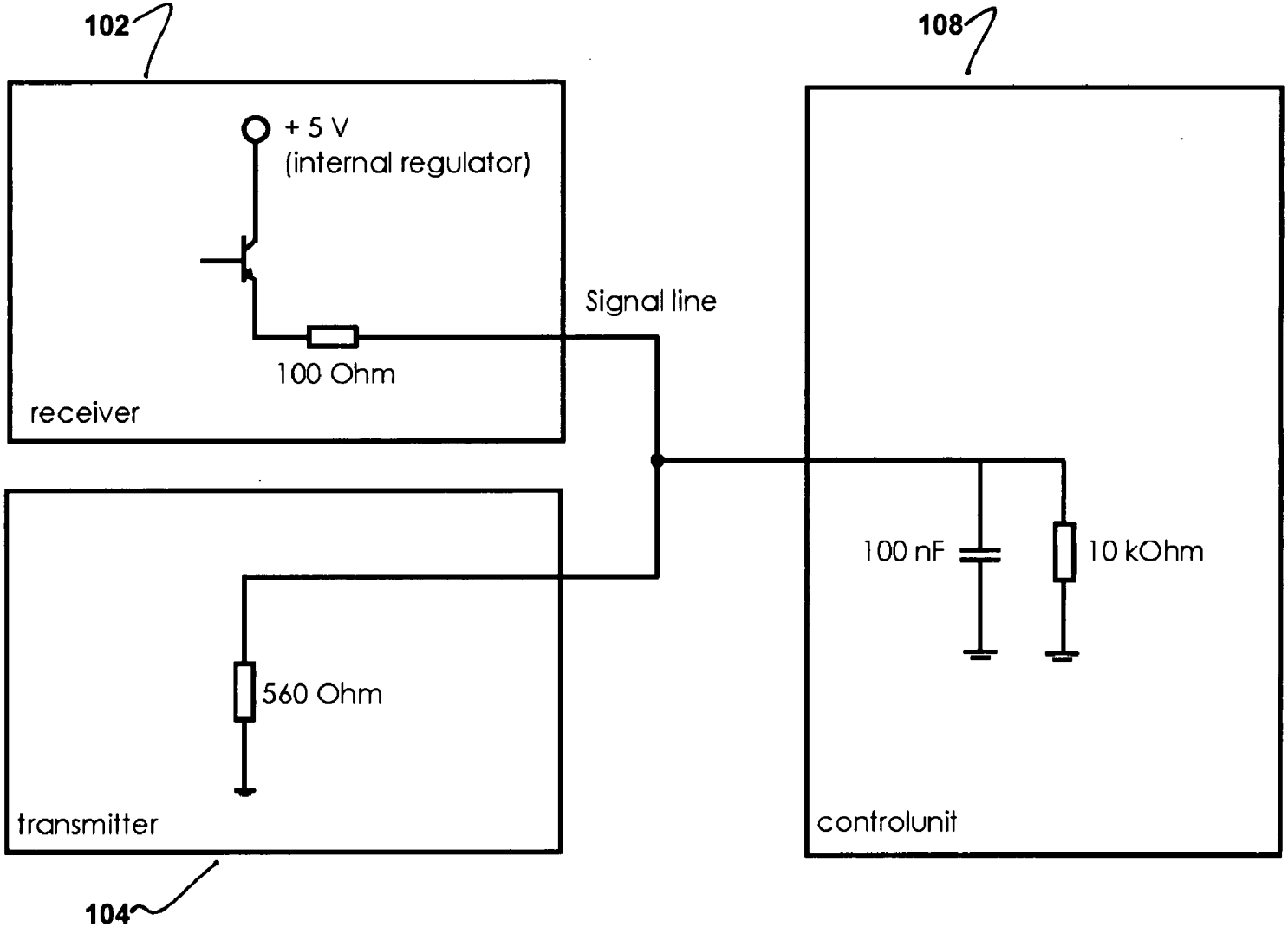
FIG. 1 is a schematic diagram of the connection of the control unit to the signal line.

The present invention is an optical safety edge and control system which functions correctly despite changes in ambient conditions and/or deformation of the sensor.

Let us consider the working principle of an optical safety edge. The opto-electronic safety edge is based on a coupled transmitter/receiver pair. In the standard configuration (fail-safe mode) they are connected in parallel to the power (brown), the ground (white) and the signal line (green). The receiver controls the behavior of the transmitter in respect to its own state. If the receiver unit is receiving the pulsed infra-red signal, it switches off the transmitter after a delay of about 600 microseconds. Thus the receiver doesn't 'see' any pulsed infra-red light signal and switches on the transmitter after a delay of again 600 μs.

Due to this communication between the receiver and the transmitter there is a dynamic signal on the signal line (frequency about 800 Hz). This signal is only detectable if the edge is not pressed. In case of a defect or an obstacle, which interrupts the light beam, the oscillation stops. This dynamic principle offers a high safety level without any complex control units. The actual safety category (regarding DIN EN 954) is only dependent on the control unit. The receiver and transmitter fulfill all requirements for the highest safety level, which is category 4.

The transmitter and receiver each have three wires (lines). The brown line is the power supply (+12 V DC), the white line is ground (0 V) and the green line is the signal line to supply the transmitter with the information of the receiver. The power consumption depends on the length of the light barrier. Because of the damping of the light in the profile, the power of the transmitter has to be adapted to the length of the profile. Thus the sensitivity of the safety edge is the same for different lengths of profile. (e.g. a 30 ft door edge needs about 35 mA current, a 9 ft door edge only 1 mA. If the light beam is interrupted, the power consumption reaches its maximum.

The frequency of the system oscillation is not exactly fixed to 800 Hz, but varies with tolerances of the electronic components. Also, with bad light transmission from transmitter to receiver, the normally stable signal starts to jitter and the frequency decreases. Thus the control unit is designed to tolerate signals between 500 Hz and 2 kHz.

In case of light pressure on the safety edge, sometimes single pulses or bursts of single pulses appear on the signal line. This could possibly make the control unit closing the relays contacts for a short time, resulting in a chattering of the relays. The control unit suppresses this effect by means of a sufficiently long time constant (time delay) before closing the relays.

Referring to Table 1 there is summarized the technical characteristics of the system. The connection of the control unit to the signal line causes changes of the oscillation frequency.

TABLE 1

| | min | typ. | Max |
|---|---|---|---|
| Supply voltage (stabilized) | +8 V DC | +12 V DC | +14 V DC |
| Current consumption (average value) (depending on length and state (activated or not activated) of the edge) | 7 mA | | 40 mA |
| Max. power consumption (average value) Worst Case condition | | | 560 mW |
| Pulse frequency of infrared light | | ~38,5 kHz | |
| Wavelength of IR light | | 950 nm | |
| Signal level-Logic 1 | 3.0 V | | |
| Signal level-Logic 0 | | | 1.0 V |
| Frequency of oscillation | | 500 Hz < $f_{Signal}$ < 2 kHz | |
| Duty cycle | | ~50% | |
| Missing pulses due to self adjusting transmitter per 10 ms | | 1 | 2 |

Figure 2:
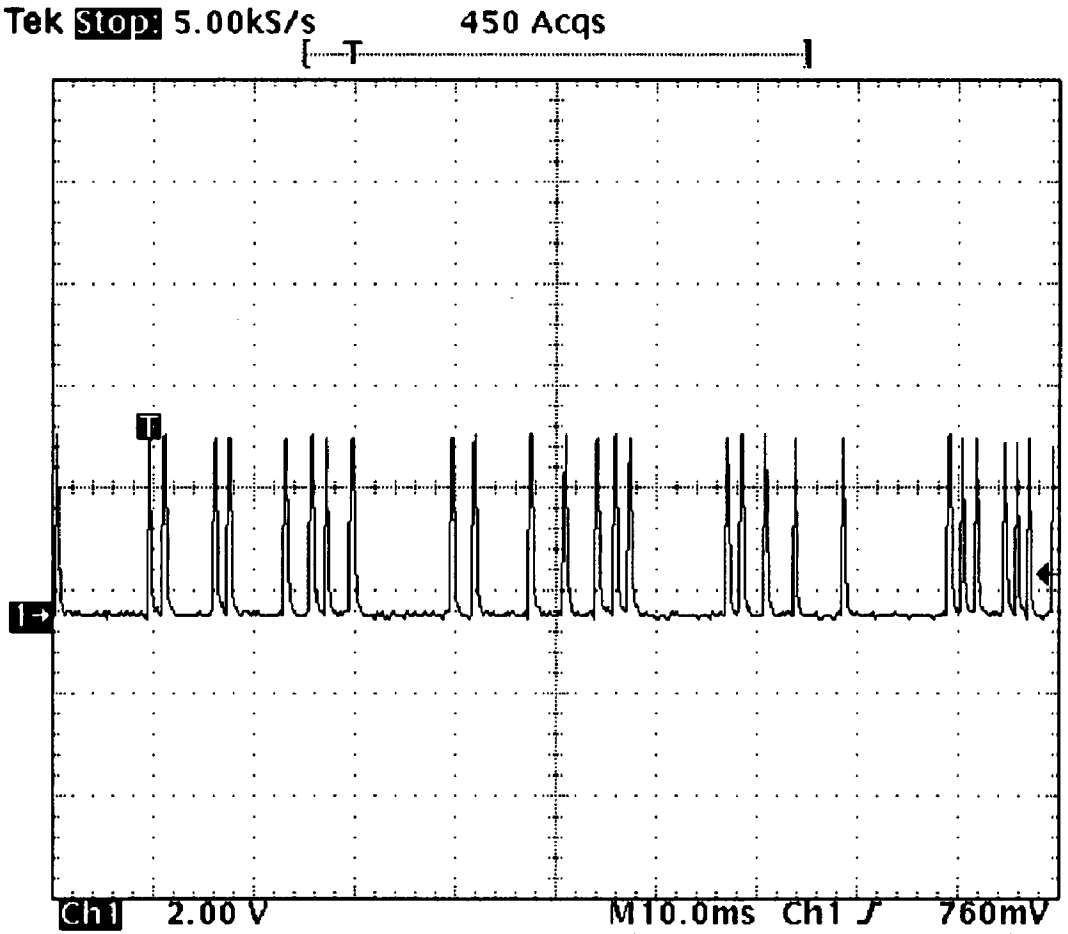
FIG. 2 is a graphical representation of the receiver transmitter signal.

The control unit is used to analyze the transmitter receiver signal, without taking any influence. The control unit has to detect, if the frequency is not in the specified range. In this case the moving edge has to be stopped immediately. The tolerances of the signal, the jittering and the bursts have to be taken into consideration. This means the signal has to be observed during a certain time window. The signal of the transmitter receiver system just before the control unit should stop the edge is shown in FIG. 2.

The point when the control unit decides to stop the edge, of necessity is always a compromised balance between the reaction time and the detailed analysis of the signal. The following methods to analyze the dynamic signal can be used: rectifying the dynamic signal; counting the pulses (measuring the frequency) with standard digital logic; or counting the pulses (measuring the frequency) in a microprocessor.

Rectifying the Dynamic Signal

The standard control unit of the OSE is based on this principle. The dynamic signal passes through a bandpath-filter and is amplified to 12V. After this amplification the signal is analyzed in two redundant circuits. In each path the signal is filtered again and rectified. This DC-Voltage controls a transistor-stage which drives a relay. A normally closed contact is used. The output contacts of the paths are connected in series. Discrete components are used for the circuit.

Two different time constants are realized in order to avoid rattling relay contacts and to get a fast response time. The working principle is equivalent to an retriggerable monoflop. If the frequency is below the specified value, the rectified DC-voltage drops below a threshold, which causes the transistor stage to release the relay. The normally closed contact opens. The first (short) time-constant defines how many pulses have to be absent until the relay is released. At the moment this takes about 25 ms. If the rectified DC-Voltage is below the threshold the second time constant determines the time until the relay is activated again (the contact is closed). This time is about 500 ms. In this period the signal has to be stable in order to raise the rectified voltage to the nominal value.

Instead of discrete components an IC (e.g. 4538) could be used or an ASIC (Application Specific Integrated Circuit) can be used. If both monoflops are coupled and the correct external components are used, both time constants could be realized easily. The static output signal can be used to control the output contacts (relay, opto coupler).

Measuring the Frequency

Figure 3:
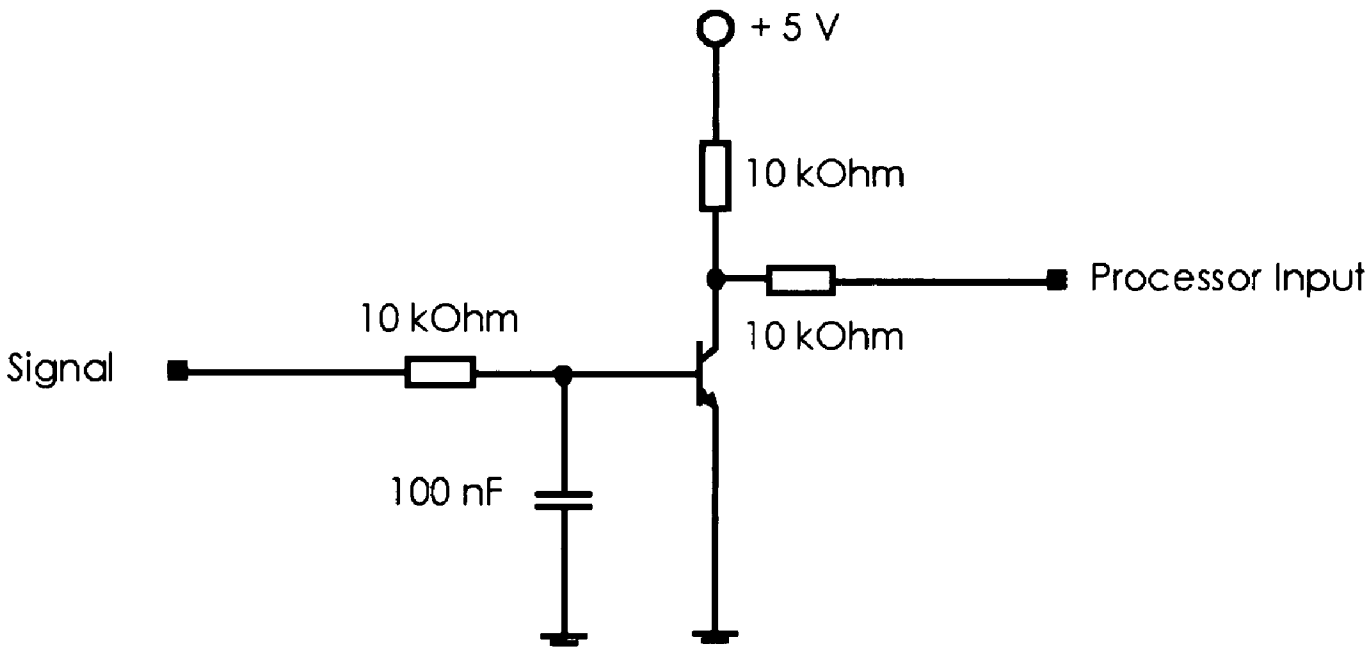
FIG. 3 is a schematic diagram of the input circuit for a microprocessor controller; and, FIG. 4 is a partially exploded perspective view of a door panel with optical edge sensor installed.

The frequency of the receiver transmitter signal could be determined by counting the pulses during a defined time slice. It is possible to use standard logic ICs (e.g. 4520) or a microprocessor. The width of the sensitive time slice and the number of pulses which have to be counted during this period are the important parameters. After several measurements we would propose the following values. 10 ms is the minimal width of the time period. If this value is chosen, less than 2 pulses should cause the control circuit to stop the moving edge. The second time constant should define a longer time (more than 200 ms) in which the specified frequency must occur after the edge has been stopped before the normal operation of the moved edge is allowed by the control unit. Possible microprocessor input pins are e.g. interrupt pins or counter inputs. An exemplary circuit to adapt the receiver transmitter signal to the microprocessor is shown in FIG. 3. If electrical isolation is necessary or desired than an opto coupler can be used. The signal line should not drive the diode directly.

Principle

The present invention optical edge sensing system with signal authentication adjusts the transmitter light power automatically to the length and charging environmental characteristics of the sensing edge. The transmitter runs an adjustment algorithm at regular intervals. After the transmitter is turned on the systems adjusts to the basic setting. The transmitter light power adjusts as follows: The transmitter finds the minimal power level that is necessary to send the light through the profile to the receiver. On top of this value the program ads a reserve to make the edge insensitive against vibrations, bending, uneven floors, etc. This reserve varies in dependence on the actual light power level. Wider doors (higher light power level) need more reserve than short doors (lower light power level). The operation power (minimal power level+reserve) can increase and decrease under certain circumstances.

Decreasing the Operation Light Power

The transmitter checks permanently if the light power can be decreased. This algorithm guarantees the maximum sensitivity (safety) of the edge.

Increasing the Operation Light Power

To compensate for long-term system and component effects such as aging of the LED, change of the profile material, etc. the transmitter can increase its light power level. If an increase is necessary a maximum step is defined. The increase is restricted to keep the sensitivity of the edge. After the sensing edge is turned on and the components have reached their operation temperature the adjustment program allows an increase of light power. Further increases are possible after a longer period of time. If the light beam in the edge is interrupted the adjustment process is stopped completely. The light power level will remain on the last value, before the light beam was disconnected.

Details of Operation

During power up a number of functions are implemented. The functions cover an intermission, sending the version number, the bypass into the test mode and a further intermission. The functions are exactly specified in the transmitter framework often commodity, therefore only a short description is here given. After the conclusion of the starting break 2 it gives to branch out no more possibility to the test mode (except over an interruption of the current supply). The entire starting time lasts 15 ms to the test mode is if not branched out (normal operation).

After a starting break 1 the transmitter sends the version number over the light emitting diode. Minutes correspond to the framework often commodity specification. The transmitting time typically lasts 2.8 ms.

After sending the version number the transmitter inserts a further break. The transmitter examines the green line within the break for a valid test mode key.

The normal length of the waiting break is 7,2 ms, if the transmission of the key did not begin in this time the break without bypass into the test mode is then terminated. Afterwards the transmitter changes into the normal operation.

If the transmission of the test mode key begins, and/or if on the green line a start element one recognizes, the break is broken off and the key is queried.

If the key is incorrect (disturbance) the receipt interrupted, and implemented by 5 ms (in this break the test mode key is not any longer queried) to it the transmitter changes a further starting break into the normal operation.

If the valid test mode key on the signal line (green) is recognized, the transmitter branches out to the test mode.

In the test mode the transmitter is steered by the test equipment via the green line. By the exact definition of the test run in the test equipment and transmitter a simpler test can be accomplished, as if the test equipment must simulate a receiver, and exact operating points of the transmitter inclusion.

In the test mode the transmitter is steered by the test equipment via the green line. By the exact definition of the test run in the test equipment and transmitter a simpler test can be accomplished, as if the test equipment must simulate a receiver, and exact operating points of the transmitter inclusion.

General Sequence

The test mode is started after the Power-up, if the transmitter recognizes a valid test mode key on the green signal line.

The testing set steers the expiration of the test routine via tax pulses on the green line. The testing set steers the expiration of the test routine via tax pulses on the green line.

The transmitter accomplishes temporally limited tasks after each tax pulse.

After the processing of a test unit the transmitter waits for a certain time for the next tax pulse. If the tax pulse is not recognized in the appropriate time, the test mode is left.

After the last tax pulse, or if an expected tax pulse does not come too late or leaves the test equipment the test mode.

When the test mode is left, a break of the length starting break is implemented. Afterwards the transmitter begins with the normal operation.

Test Sequence

Operation Without Transmission Power

The transmitting power is completely switched off by the processor and the current consumption in the transmitter is minimized. The testing set measures the current consumption.

Operation with Full Transmission Power

The processor switches the maximum transmitting power on. The LED is operated with lasting stream, and does not pulse! The transmitter is operated only very briefly in this kind, so that no overloading arises to the LED. Afterwards a long cooling break is intended before the further test steps. The testing set measures the current consumption of the transmitter.

Transmission BETWEEN Bit 0 and Bit 5

In these test units the transmitter radiates the transmitting power for the specified duration on only one output stage. Constantly a 38 kHz signal is radiated as in the normal operation. After possibility the same soft-wait-hurry (no copy) as in the normal operation used whereby the different bursts smoothly together are added. The testing set measures the light radiation.

Reaction Time High Level

The transmitter radiates first no light. If the transmitter registers the level as High, a signal is spent over the light emitting diode (strongest achievement for 0,1 ms to switch on). The attempt is cyclically repeated 10 times.

Reaction Time Low Level

The transmitter radiates first no light. The testing set switches the level of High to Low. If the transmitter registers the level as Low, a signal is spent over the light emitting diode (strongest achievement for 0,1 ms to switch on). The examination is cyclically repeated 10 times.

During the normal system operation the following functions are implemented.

Adjustment

The rule algorithm is implemented for instance 4× per second. The following steps are accomplished. With entrance into the normal operation as the first this function is implemented. Regulating is implemented independently of whether the receiver sees light or not. For the power adjustment 63 stages are available. By the not linear arrangement of the stages the lower stages are no longer relevant however with higher achievements, so that in the reason of 8 stages for long borders and 8 for short borders for the order.

Measurement

The achievement is determined, which is minimum necessary, in order to reach the receiver. The receiver answers only digital, therefore the border with several measuring steps must be tried out.

The transmitter sends achievement Bursts of maximally 26 pulses, which can be examined, for everyone. After each pulse the signal line is queried whether the receiver saw the light. The transmitter sends achievement Bursts of maximally 26 pulses, which can be examined, for everyone. After each pulse the signal line is queried whether the receiver saw the light.

Around a smaller achievement than permissible recognizing this must be recognized in two Prue bursts clearly. An individual Bursts meant that the performance level was too small, a second attempt can be void then. If the second attempt does not come through, the achievement is interpreted as to small.

By suitable tracing before sending one achievement which can be examined is guaranteed that the receiver does not have memory of earlier light more. This transmission break is called whenever a Pruefburst did not become to receive. If the Burst became to receive the break by the deceleration time in the receiver reacted, only the time-delayed again switches on.

By the rule algorithm it may not come so for a long time to being missing the signal that a signal processing responds. (in the worst case at least 2 pulses in 5 ms are to arise) with a before de-energised switching border also during regulating. By intermediate pulses with the normal achievement (and the normal pulse number? so far not!) it is reached that none develop to long tracing on the signal line, if several measuring pulses are not seen, so that signal processing does not respond by regulating. (theoretically 6 not seen pulses can occur one behind the other in consequence, however the transmission would be then anyway nearly impossible.

Intermediate pulses are not necessary, if the last test pulse were seen.

Selection of Reference Value

The reference value for the minimum necessary achievement is selected from the 16 measured values.

In the instant where 16 values are present, freely implemented the regulation that means that that is permitted high rules and each elevator restriction is waived, so that too small fixed achievements can be now corrected by measuring errors with the first measurements. (the number of 16 is arbitrarily selected. With increase the response time of the transmitter for achievement lowering rises! This computes itself as number of memory values x rule interval. The choice represents a compromise between time (high values may not remain to for a long time in the system) and stability (enough measurements from a sufficiently large period), at the moment to 4 s.

Calculation of Reserve

Calculation of reserve on the basis of the selected reference value is computed the desire achievement. But the achievement is subjected dependent on your height with a reserve against spontaneous degradations of the light transmission, such as that caused by vibration, shaking, etc. The reserves for the respective performance levels were experimentally determined, so that borders of different length/qualities can bear the disturbances which can be accepted good.

If the measuring stage (value in register Intens) lies in range 1 (value smaller than 5), then no reserve is given.

If the measuring stage is appropriate in range 2 (value more largely or equivalent 5 however smaller than 7), then follows the increase around a quarter of the achievement (the value in register Intens is increased by a quarter).

If the measuring stage within range 3 lies (value more largely or directly 7, then is increased the value by 16 (bits 4, 010000).

If the result of the computation is larger than the maximum power Imax, then the maximum power Imax is used as result.

Adjustment of the Power in Dependence on the Old Power Level

Adjustment of the power into dependence on the old power level the actual new achievement is determined as a function of the desire achievement and the old achievement (before regulating), and independently of it whether for this control procedure an achievement increase is permitted (time-steered, achievement increase approximately 1× per grant achievement increase limited, achievement lowering always permits.

If the result of the computation of the permitted maximum power is larger than the absolute maximum power I_max, then the absolute maximum power I_max is accepted as maximum.

If the again determined desire achievement is smaller in Intens than the old achievement in Int_alt, then the again determined desire achievement is maintained.

If the again determined desire achievement is larger than old achievement and P_up is not set, then the old achievement is maintained.

If the again determined desire achievement is larger than the old achievement and than the permitted maximum power and P_up is larger set, then the permitted maximum power is used in Intens as the new achievement.

If the again determined desire achievement is larger than the old achievement and than the permitted maximum power and P_up is smaller set, then the again determined desire achievement is used in Intens as the new achievement. Transmission of burst signal sending a Standardbursts. With the current performance level pulses are sent.

A transmission break is implemented, if the receiver did not react on the last Burst. The transmission break is necessary, so that the receiver forgets possibly light portions already stored again. Furthermore a minimum transmission break for the LED is reached, so that this ages not unnecessarily, if no contact is possible to the receiver. The transmission break is not implemented, if the receiver saw the light. In this case the necessary deceleration time is already realized in the receiver.

Pause

Break if the receiver reacted to the Sendbursts is repeated not inserted longer break, in which the transmitter does not send no more. The timing continues to run in the pause, so that the distances of the rule cycles are not excessively expanded. The dead time serves the indulgence of the light emitting diode with switched off border.

If the receiver did not react to 4 Sendbursts in consequence with High level on the signal line, then the dead time is started. If occasionally a Burst was again received begins the counting a new.

In the dead time the transmitter makes a break of 50 ms. In the dead time the timing will only become not higher further operated, so that the distances of the rule cycles and the times at those the achievement may be increased.

The system can also be implemented as an embedded device, such as an application specific integrated circuit (ASIC), an integrated circuit chip set, or within a larger integrated circuit.

Figure 4:
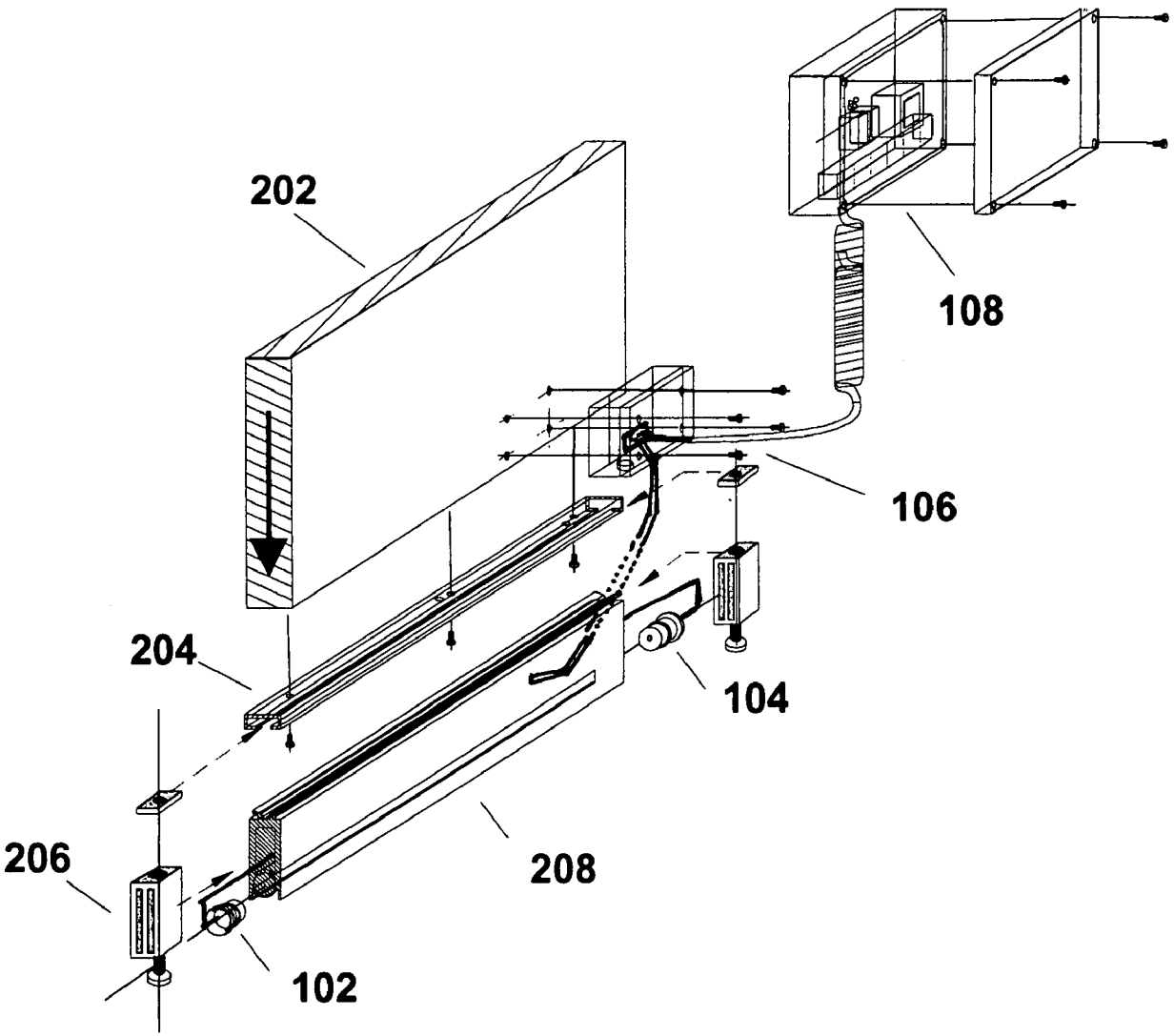

Referring to FIG. 4 there is shown a partially exploded perspective view of a door panel with optical edge sensor installed. A power door panel 202 has an has an edge rail 204, which can be an aluminum C-rail, bumpers 206 and a deformable edge 208. A transmitter 102 is mounted at one end of the deformable edge 208 and a receiver 104 is mounted at the other end of the deformable edge 208. The transmitter 102 and the receiver 104 are electrically coupled to a junction box 106. The junction box 106 is electrically coupled to a control unit 108 through a flexible wire. Alternatively the junction box 106 may be wirelessly coupled to the control unit 108.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications, which come within the scope of the appended claim, is reserved.

What is claimed:

1. An optical safety edge and control system comprising:

a deformable safety edge having a first end and a second end;

an optical transmitter coupled to the first end of the deformable safety edge;

an optical receiver coupled to the second end of the deformable safety edge such that the optical transmitter is optically coupled to the optical receiver when the deformable safety edge is not deformed and is not optically coupled to the optical receiver when the safety edge is deformed;

a control until electrically coupled to the optical transmitter and the optical receiver wherein the control unit detects signals received from the optical transmitter by the optical receiver and the power level of the optical transmitter is adjusted by the control unit;

wherein the power level of the optical transmitter is adjusted to compensate for changes in signals received from the optical transmitter by the optical receiver.

2. The optical safety edge and control system as recited in claim 1 wherein ambient conditions which effect signals received from the optical transmitter by the optical receiver are compensated by adjusting the power level of the optical transmitter whereby false responses and system failures are reduced.

3. The optical safety edge and control system as recited in claim 1 wherein minor deformations of the optical safety edge which effect signals received from the optical transmitter by the optical receiver are compensated by adjusting the power level of the optical transmitter whereby false responses and system failures are reduced.

4. The optical safety edge and control system as recited in claim 1 wherein ambient conditions which effect signals received from the optical transmitter by the optical receiver are compensated by adjusting the power level of the optical transmitter at start up whereby false responses and system failures are reduced.

5. The optical safety edge and control system as recited in claim 1 wherein ambient conditions which effect signals received from the optical transmitter by the optical receiver are compensated by adjusting the power level of the optical transmitter during a test interval.

6. The optical safety edge and control system as recited in claim 1 wherein ambient conditions which effect signals received from the optical transmitter by the optical receiver are compensated by adjusting the power level of the optical transmitter periodically.

7. The optical safety edge and control system as recited in claim 1 wherein the power level of the optical transmitter is adjusted automatically to compensate for different lengths of deformable safety edge whereby sensitivity of the deformable safety edge is the same for different lengths of deformable safety edge.

8. The optical safety edge and control system as recited in claim 1 wherein the control unit includes a sufficiently long time delay whereby single pulses or bursts of single pulses do not result in the control unit closing relay contacts for a short time.

9. The optical safety edge and control system as recited in claim 1 wherein conditions which effect signals received from the optical transmitter by the optical receiver are compensated by adjusting the power level of the optical transmitter by an adjustment algorithm.

10. The optical safety edge and control system as recited in claim 9 wherein the adjustment algorithm is initiated at regular intervals.

11. The optical safety edge and control system as recited in claim 9 wherein the adjustment algorithm is initiated on power up.

12. A method for reducing false responses and system failures of an optical safety edge and control system, the method comprising the following step:

transmitting an optical signal from an optical transmitter, operated at a power level, through a deformable safety edge;

receiving the optical signal transmitted thought the deformable safety edge;

detecting signals received from the optical transmitter by the optical receiver;

adjusting the power level of the optical transmitter;

wherein the power level of the optical transmitter is adjusted to compensate for changes in signals received from the optical transmitter by the optical receiver.

13. The method for reducing false responses and system failures of an optical safety edge and control system as recited in claim 12 wherein ambient conditions which effect signals received from the optical transmitter by the optical receiver are compensated by adjusting the power level of the optical transmitter.

14. The method for reducing false responses and system failures of an optical safety edge and control system as recited in claim 12 wherein minor deformations of the optical safety edge which effect signals received from the optical transmitter by the optical receiver are compensated by adjusting the power level of the optical transmitter.

15. The method for reducing false responses and system failures of an optical safety edge and control system as recited in claim 12 wherein ambient conditions which effect signals received from the optical transmitter by the optical receiver are compensated by adjusting the power level of the optical transmitter during a test interval.

16. The method for reducing false responses and system failures of an optical safety edge and control system as recited in claim 12 wherein the power level of the optical transmitter is adjusted automatically to compensate for different lengths of deformable safety edge whereby sensitivity of the deformable safety edge is the same for different lengths of deformable safety edge.

17. The method for reducing false responses and system failures of an optical safety edge and control system as recited in claim 12 wherein the control unit includes a sufficiently long time delay whereby single pulses or bursts of single pulses do not result in the control unit closing relay contacts for a short time.

18. The method for reducing false responses and system failures of an optical safety edge and control system as recited in claim 12 wherein conditions which effect signals received from the optical transmitter by the optical receiver are compensated by adjusting the power level of the optical transmitter by an adjustment algorithm.

19. The method for reducing false responses and system failures of an optical safety edge and control system as recited in claim 12 further comprising initiating the adjustment algorithm at regular intervals.

20. The method for reducing false responses and system failures of an optical safety edge and control system as recited in claim 12 further comprising initiating the adjustment algorithm on power up.

* * * * *